US011168560B2

(12) United States Patent
Marcuccio et al.

(10) Patent No.: US 11,168,560 B2
(45) Date of Patent: Nov. 9, 2021

(54) PORT AND SNORKEL FOR SENSOR ARRAY

(71) Applicant: HALLIBURTON ENERGY SERVICES, Houston, TX (US)

(72) Inventors: Suzi Marie Marcuccio, Conroe, TX (US); Clint Adam Brown, Port Jefferson, NY (US); Paul Gregory James, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 334 days.

(21) Appl. No.: 16/482,092

(22) PCT Filed: Feb. 7, 2018

(86) PCT No.: PCT/US2018/017282
§ 371 (c)(1),
(2) Date: Jul. 30, 2019

(87) PCT Pub. No.: WO2018/160328
PCT Pub. Date: Sep. 7, 2018

(65) Prior Publication Data

US 2020/0116009 A1 Apr. 16, 2020

Related U.S. Application Data

(60) Provisional application No. 62/467,037, filed on Mar. 3, 2017.

(51) Int. Cl.
*E21B 47/017* (2012.01)
*E21B 43/10* (2006.01)
(Continued)

(52) U.S. Cl.
CPC ..... *E21B 47/017* (2020.05); *E21B 43/10* (2013.01); *E21B 47/06* (2013.01); *E21B 49/081* (2013.01)

(58) Field of Classification Search
CPC ... E21B 47/017; E21B 47/0175; E21B 47/013
See application file for complete search history.

(56) References Cited

U.S. PATENT DOCUMENTS 6,766,703 B1 * 7/2004 Kluth ..... E21B 47/06 73/866.5
8,336,627 B2 * 12/2012 Patel ..... E21B 43/14 166/325

(Continued)

FOREIGN PATENT DOCUMENTS

EA 009637 B1 2/2008
RU 2374440 C2 11/2009

OTHER PUBLICATIONS

Russian Office Action; Application No. 2019120504; dated Dec. 30, 2020.

(Continued)

*Primary Examiner* — Shane Bomar
(74) *Attorney, Agent, or Firm* — Polsinelli PC

(57) ABSTRACT

An array of sensors provided on the outside of a tubular string for measuring a property within the tubular string. The array of sensors may include a plurality of connected sensors, wherein at least one of the plurality of connected sensors is at least partially encompassed in a shroud. A snorkel line may extend from the shroud, the snorkel line capable of coupling with a sensor port in a tubular of the tubular string. The snorkel line may establish fluid communication between one of the sensors at least partially encompassed in the shroud and a corresponding sensor port of a tubular in the tubular string.

41 Claims, 7 Drawing Sheets

(51) Int. Cl.
*E21B 47/06* (2012.01)
*E21B 49/08* (2006.01)

(56) References Cited

U.S. PATENT DOCUMENTS

| | | | | |
|---|---|---|---|---|
| 2002/0064206 | A1 | 5/2002 | Gysling et al. | |
| 2004/0251048 | A1* | 12/2004 | Kurkoski | E21B 47/01 175/41 |
| 2008/0000635 | A1 | 1/2008 | Rioufol et al. | |
| 2009/0008078 | A1 | 1/2009 | Patel | |
| 2011/0079391 | A1* | 4/2011 | Bedouet | E21B 47/017 166/302 |
| 2013/0145837 | A1* | 6/2013 | Yamate | E21B 49/00 73/152.28 |
| 2014/0367084 | A1 | 12/2014 | Richards et al. | |
| 2016/0177702 | A1* | 6/2016 | Buck | G01V 11/002 73/152.54 |
| 2016/0201448 | A1 | 7/2016 | Patel | |
| 2017/0241257 | A1* | 8/2017 | Li | E21B 47/017 |
| 2020/0224528 | A1* | 7/2020 | Fripp | E21B 47/07 |

OTHER PUBLICATIONS

English abstract of RU2374440; retrieved from www.espacenet.com on Feb. 11, 2021.
English abstract of EA009637; retrieved from www.espacenet.com on Feb. 11, 2021.
International Search Report and Written Opinion; PCT Application No. PCT/US2018/017282; dated May 18, 2018.

* cited by examiner

PORT AND SNORKEL FOR SENSOR ARRAY

CROSS-REFERENCE TO RELATED APPLICATIONS

This application is a national stage entry of PCT/US2018/017282 filed Feb. 7, 2018, which claims the benefit of U.S. Provisional Application No. 62/467,037, and each of the aforementioned applications are expressly incorporated herein in their entirety.

TECHNICAL FIELD

The present technology is directed to downhole sensors for measuring fluid properties. In particular, the present technology involves sensors provided with tubing, such as production tubing for determining various downhole properties.

BACKGROUND

Wellbore completion involves preparing a well for hydrocarbon production after drilling operations have been conducted. During this phase production tubing may be provided downhole for injecting various fluids or withdrawing hydrocarbon. Stimulation processes may have also been conducted including creating fractures in the formation. During these completion processes packers may be provided to isolate various zones along the length of the tubing and wellbore. These zones may isolate particular areas to facilitate production of hydrocarbon from the fractured portions of the formation.

During the completion phases, it is desirable to measure properties of the fluid, formation or tubing. Accordingly sensors may be provided downhole at various points of the tubing to collect data for processing.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
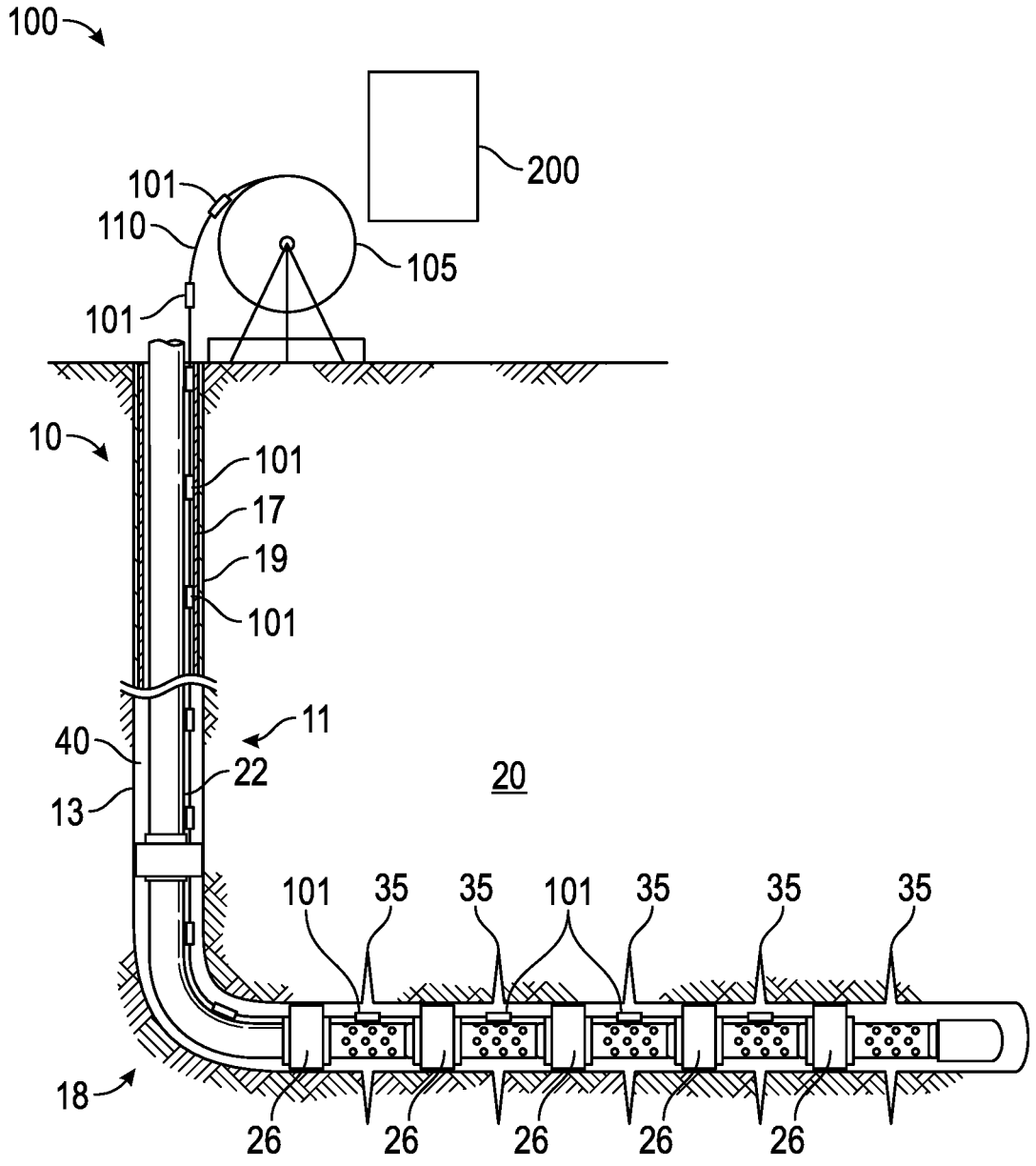
FIG. 1 is a schematic diagram of a tubular string provided in a wellbore for completion processes.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

As used herein, the term "coupled" is defined as connected, whether directly or indirectly through intervening components, and is not necessarily limited to physical connections. The terms "communicatively coupled" or fluidically coupled encompass establishing fluid communication of a fluid such as gas, liquids, hydrocarbons, borehole fluids and the like. The connection can be such that the objects are permanently connected or releasably connected.

Overview

The present disclosure provides for a snorkel for fluid communication from a sensor to a sensor port in a tubular of a tubular string. The tubular string may have a collar provided along its length and covering the sensor port. The collar may itself have a collar port which aligns and fluidically communicates with the sensor port in the tubular. The collar may have a seat or other coupling for receiving a connector, such as a ferrule type tubing connector, so as to provide a sealed coupling. The connector provides a sealing engagement (i.e. sealing coupling) with a snorkel which extends to a sensor in a sensor array external the tubular. The sensor may be encompassed by a shroud, which may be elastomeric or rigid, and may provide a chamber for the sensor. The snorkel may itself have a fluid channel, so that a fluid channel extends from the connector to within the shroud. This way, a fluid communication channel can communicatively extend from a central flow passage of a tubular through the collar, the connector, and the snorkel to the sensor. Accordingly, temperature, pressure, or other fluid property within the tubular can be measured.

Accordingly, the disclosure enables the ability to port a sensor array to production tubing and not have to perform operations on a tubing encased conductor ("TEC") or other conductive line, such as (but not limited to) welding and splicing, nor make up electrical connections. Also the disclosure herein may serve as protection for the array sensor (for example, pressure or temperature sensors). The snorkel line allows for flexibility so that there is no requirement to be exact as to where the sensor falls in a completion—it may just be ported to the closest coupling or dedicated port above or below.

Additionally, sensors herein can be a dual transducer sensor, where one portion of the sensor can be left as is, for example with detector ports open to the annulus between the exterior of a tubular string and the surface of the borehole. Another portion of the sensor may be encompassed in the shroud discussed above thereby covering a number of detector ports. This way, the shroud may encompass a portion of the sensor, so that at least one set of the detector ports of the sensor are covered, and may be chambered to fluidly communicate through the snorkel to the central flow passage, whereas a second set of detectors ports on the surface of the sensor is left open to the annulus for sensing a fluid property in the annulus (such as annulus 40 in FIG. 1 discussed below). Additionally, sensors herein can have a plurality of transducers in each sensor, wherein there are some of the plurality of portions left open to the annulus and others of the plurality of portions encompassed by the shroud.

One or more other sensors in the sensor array may be external the tubular string and sense a fluid property in the annulus and not the fluid flowing in the tubular. This way both the fluid in the annulus and within the tubular may be detected by sensors outside of the tubular string. Furthermore, the port and snorkel disclosed herein facilitate easy preparation by service providers on the surface deploying the tubular string and the array of sensors.

DESCRIPTION

FIG. 1 is a schematic diagram depicting an environment in which the present disclosure may be implemented. As illustrated, the environment includes a completion 10. Although a completion is illustrated in FIG. 1, the present disclosure may be implemented in a well with no production, flow, or injection as well, and may operate equally as well without packers, isolated zones, as well as in alternative phases of a well which are not under completion. With respect to the embodiment shown in FIG. 1, the completion 10 includes a tubular string 22 for use in completion and stimulation of formation, and an annulus 40. The terms stimulation and injection, as used herein, can include fracking, acidizing, hydraulic work and other work-overs. The tubular string 22 may be made up of a number of individual tubulars, also referred to as sections or joints. The sections can include multiple tubulars assembled together, as well as blank tubing, perforated tubing, shrouds, joints, or any other sections as are known in the industry. Each of the tubulars of the tubular string 22 may have a central flow passage an internal fluid and an external surface. The phrase "tubular" may be defined as one or more types of connected tubulars as known in the art, and can include, but is not limited to, drill pipe, landing string, tubing, production tubing, jointed tubing, coiled tubing, casings, liners, or tools with a flow passage or other tubular structure, combinations thereof, or the like.

A wellbore 13 extends through various earth strata. Wellbore 13 has a substantially vertical section 11, the upper portion of which has installed therein casing 17 held in place by cement 19. Wellbore 13 also has a substantially deviated section 18, shown as horizontal, that extends through a hydrocarbon bearing subterranean formation 20. As illustrated, substantially horizontal section 18 of wellbore 13 is open hole. It is understood, however, that the wellbore may be cased or open, vertical, horizontal, deviated, or any other orientation.

Packers 26 straddle target zones of the formation. The packers 26 isolate the target zones for stimulation and production and which may have fractures 35. The packers 26 may be swellable packers. The packers 26 can also be other types of packers as are known in the industry, for example, slip-type, expandable or inflatable packers. Additional downhole tools or devices may also be included on the work string, such as valve assemblies, for example safety valves, inflow control devices, check valves, etc., as are known in the art. The tubing sections between the packers 26 may include sand screens to prevent the intake of particulate from the formation as hydrocarbons are withdrawn. Various suitable sand screens include wire mesh, wire wrap screens, perforated or slotted pipe, perforated shrouds, porous metal membranes, or other screens which permit the flow of desirable fluids such as hydrocarbons and filter out and prevent entry of undesirable particulates such as sand.

As shown, an array of sensors 100 is spoolable from spool 105. The array of sensors 100 is shown as having a line 110 which connect each of the individual sensors 101. The line 110 may be a cord, line, metal, tubing encased conductor ("TEC"), fiber optic, or other material or construction, and may be conductive and permit power and data to transfer over the line 110 between each of the sensors 101 and to the surface. The line 110 may be sufficiently ductile to permit spooling and some amount of bending, but also sufficiently rigid to hold a particular shape in the absence of external force. Data from the array may be provided to a processor, such as device 200 discussed further below. While the array of sensors 100 are provided within the annulus between tubular string 22 and casing 17, alternatively, the array of sensors may be provided on the outside of casing and within the cement 19 between casing 17 and wellbore surface or inside the production tubulars 22.

A completion can be divided into production zones with the use of packers. The production flow comes from the formation, and may pass through a screen, through a flow regulator (inflow control device (ICD), autonomous inflow control device (AICD), inflow control valve (ICV), choke, nozzle, baffle, restrictor, tube, valve, et cetera), and into the interior of the tubing.

Figure 2:
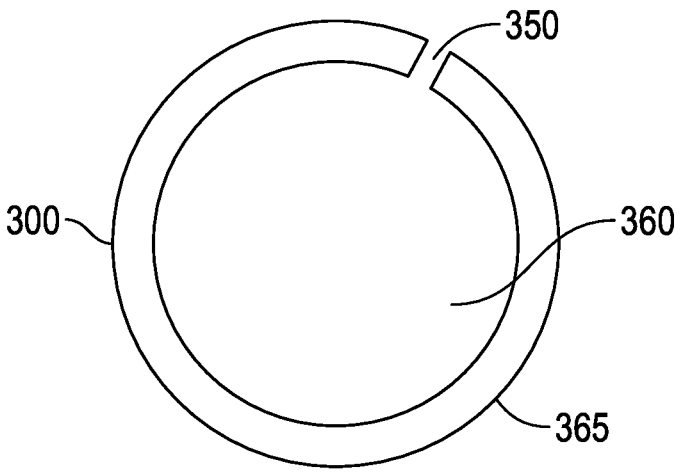
FIG. 2 is a sectional view of a tubular with a sensor port according to at least one embodiment of the present disclosure.
Figure 3A:
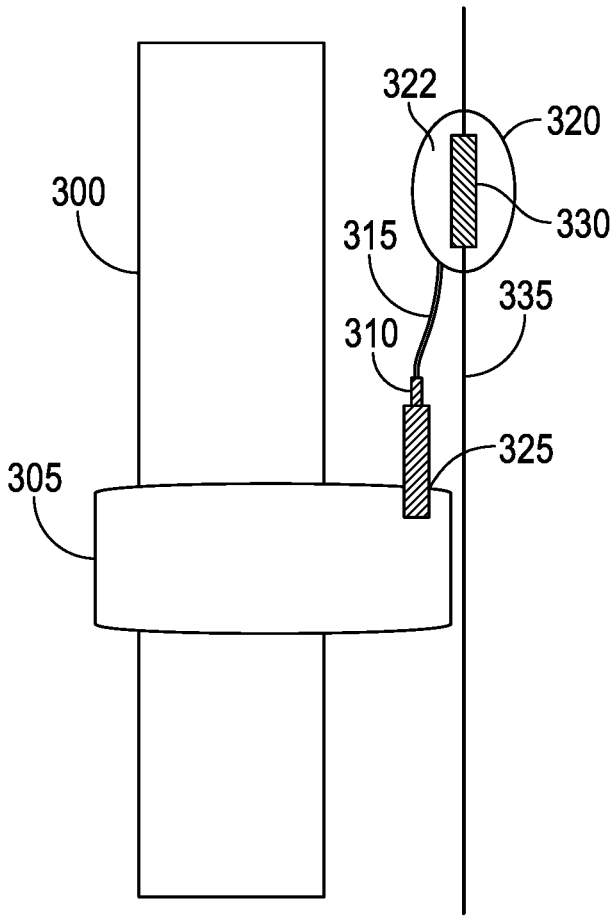
FIG. 3A is schematic diagram of a sensor with a snorkel, and connector according to at least one embodiment of the present disclosure.
Figure 3B:
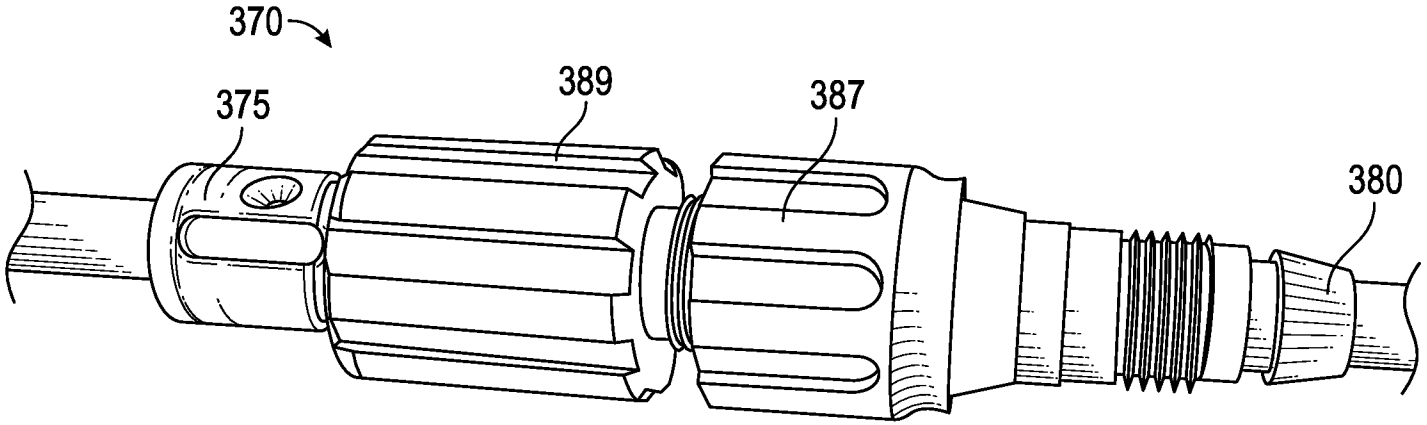
FIG. 3B is a schematic of an example connector according to at least one embodiment of the present disclosure.

FIG. 2 is a sectional view of a tubular 300 of a tubular string 22. The tubular 300 may have a central flow passage 360 and an external surface 365. A sensor port 350 may be provided in the wall extending from the external surface 365 to the central flow passage 360. FIG. 3A is a schematic diagram illustrating one example according to the present disclosure of a tubular 300 of a tubular string 22 having a collar 305 (or mandrel). It is an eccentric coupling with the belly having a seat 325 containing a connector 310. The connector may be any fluidic sealed coupling. For instance, the connector 310 may be a ferrule type tubing connector, and may also include couplings with a SWAGELOK™ fitting, National Pipe Thread (NPT), or other fitting. The connector 310 can have couplings at each end, such as a male or female connector, optionally threaded, and may contain seals for sealing engagement and coupling, and may provide for metal to metal sealing and coupling. The connector 310 may have an internal bore running along its length, for passage of fluid. Commercially available connectors include the FMJ connector by Halliburton Energy Services, Inc. which permits a metal to metal seal. The connector 310 may be any of the connector sizes for fluidic coupling with the tubular—or could be other standard industry thread. FIG. 3B illustrates a schematic diagram of an exemplary connector 370 which is a triple ferrule metal-to-metal seal connector. Accordingly, in some instances connector 310 as described herein may be the type of connector illustrated as connector 370 in FIG. 3B. The connector 370 may have a first end 375 for receiving a tubular from uphole, and may have a second end 380 for receiving a tubular or port from a tubular or collar 305 and forming a metal to metal seal with each received tubular. Rotatable handle 389 may be turned to tighten and form a metal to metal seal for the tubular entering end 380, end 375 may be rotated for a further internal seal, and rotatable handle 387 may be rotated for tertiary seal.

Figure 3C:
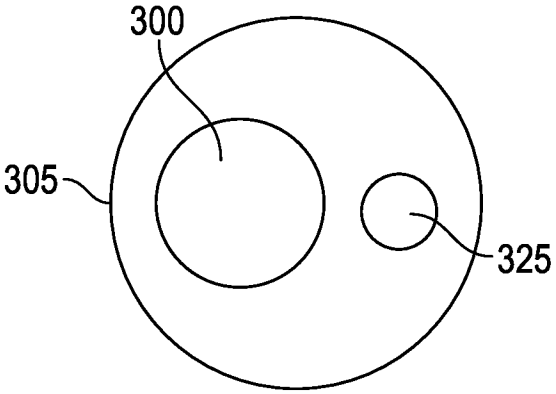
FIG. 3C is sectional view of a collar according to at least one embodiment of the present disclosure.
Figure 3D:
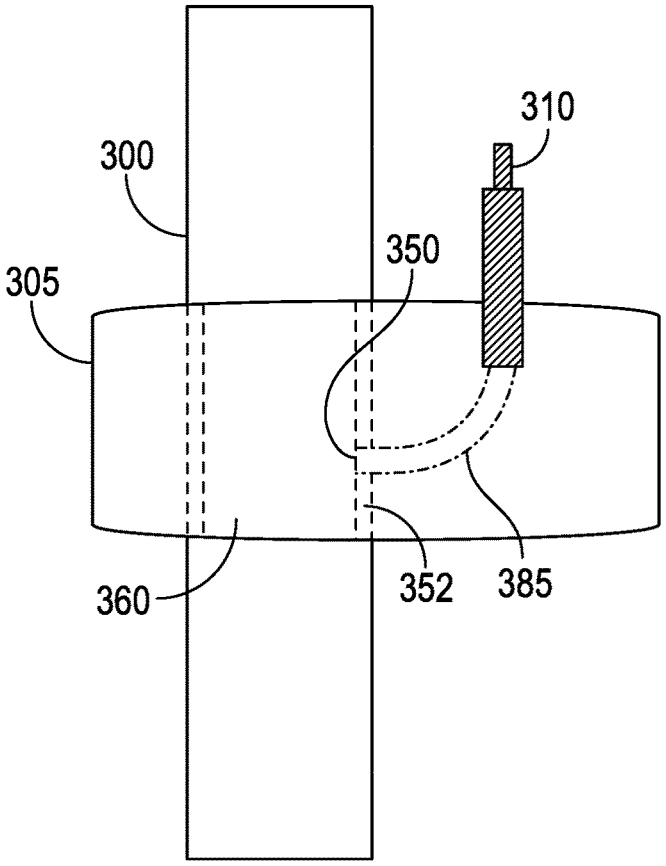
FIG. 3D is an example collar according to at least one embodiment of the present disclosure.

FIG. 3C illustrates a sectional view of a collar 305. The collar 305 can be a regular coupling, with a hole ported to inside and a block welded over the hole with an FMJ connector port, or another port, in the block. As illustrated in FIG. 3C the tubular 300 extends in one portion of the collar 305 and a seat 325 (or aperture) is provided for receiving a connector. FIG. 3D is a schematic diagram of a collar 305 coupled with tubular 300. As illustrated in FIG. 3D, the collar 305 may have a collar port 385 which may be an aperture and is communicatively coupled, establishing fluid communication, with the sensor port 350 of tubular 300. As further illustrated in FIG. 3D, the sensor port 350 may extend through the wall 352 of the tubular 300, and into the central flow passage 360. Although the sensor port 350 is illustrated with the tubular 300, any downhole tool, or tool with tubular structure, such as with an internal flow passage or cavity may be provided with a sensor port.

Figure 3E:
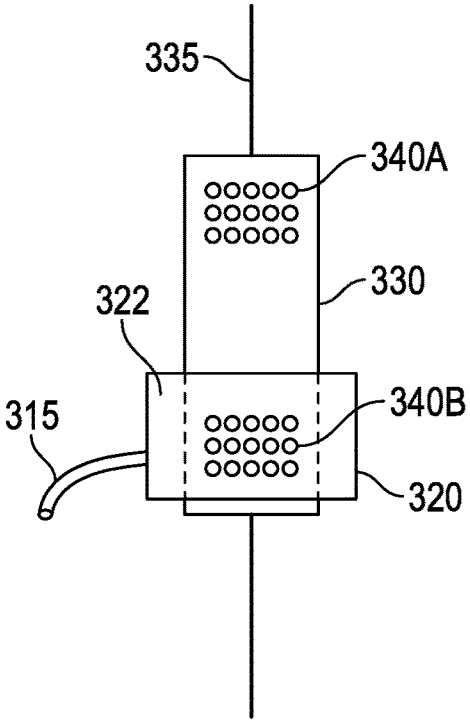
FIG. 3E is an example dual sensor according to at least one embodiment of the present disclosure.

Referring back to FIG. 3A, there may be a single sensor system (as part of an array of sensors) with the shroud 320. The shroud 320 may form a chamber 322 over entire sensor 330, or just the detector ports of the sensor 330. The shroud 320 may be elastomeric, rigid, or semi-rigid. The shroud 320 may be a clam shell type of housing that is installed at the rig floor level with an elastomeric or metallic type crush ring seal. FIG. 3E is a schematic diagram of a shroud 320 partially encompassed the sensor 330. Accordingly, although the shroud 320 encompasses the entire sensor 330 in FIG. 3A, alternatively, as illustrated in FIG. 3E the shroud 320 can partially encompass the sensor 330. In particular, sensor 330 (and each of the sensors of the array of sensors) may have sensing or detector ports such as a first set of detector ports 340A and a second set of detector ports 340B. The first set of detector ports 340A may be left uncovered and open to the annulus 40, so as to sense properties of fluid in the annulus 40. Further, the shroud 320 can cover the second set of detector ports 340B thus preventing sensing of fluid in the annulus 40. The shroud 320 may then provide a chamber 322 and establish fluidic communication with the detector ports 340B and the snorkel line 315.

Referring to FIGS. 3A-3E, the sensor 330 is attached to a line 335 (such as a TEC). This may be attached at the manufacturing level. The shroud 320 can also be attached at the manufacturing level or can be installed on the rig floor. The shroud 320 has a snorkel line 315—which may be approximately 5 to 25 ft. long, or alternatively about 15 ft. long, but can vary in length, and may be shorter or longer. As used herein the snorkel line 315 as disclosed herein refers to a fluidic tubular coupling. The snorkel line may be any flexible tubing which permits the flow of a fluid therethrough. Accordingly, the snorkel line 315 may have an internal aperture running along its length.

This snorkel line 315 may be coupled with the tubular or connector while on the rig floor just prior to deploying the tubular string 22. Snorkel line 315 may also be made to couple with the shroud 320 if the connection is a field installable connection. Accordingly, the snorkel line 315 may have fittings or connections to fluidly couple with corresponding fittings or connections on the shroud 320. Such fittings or connections may include standard threads or may be orbital weld type connection or another method of joining. Accordingly, the snorkel line 315 may establish fluid communication with the connector 310, which in turn is in fluid communication with the collar port 385 which in turn has fluid communication with the sensor port 350, which extends to the central flow passage 360 of the tubular 300. This way, fluid communication or other communication can be established to measure a property of the internal fluid of the tubular 300.

Also disclosed herein is a method of porting multiple sensors in an array. At the manufacturing level, the sensors 330 (and possibly the shroud 320) are attached in-line with the line (e.g., TEC). The shroud 320 may be sealed to the line above and below the sensor (or sealed against the sensor 330 above the sensing ports, i.e., detector ports, of the sensor 330). The snorkel line 315 can be attached to the shroud 320 and again may be approximately from 5 to 25 ft, alternatively approximately from 10 to 15 ft long and will be attached via FMJ or other connector to the closest coupling collar during install. The coupling of the snorkel line 315 to the connector 310 may be above or below the sensor.

Figure 3F:
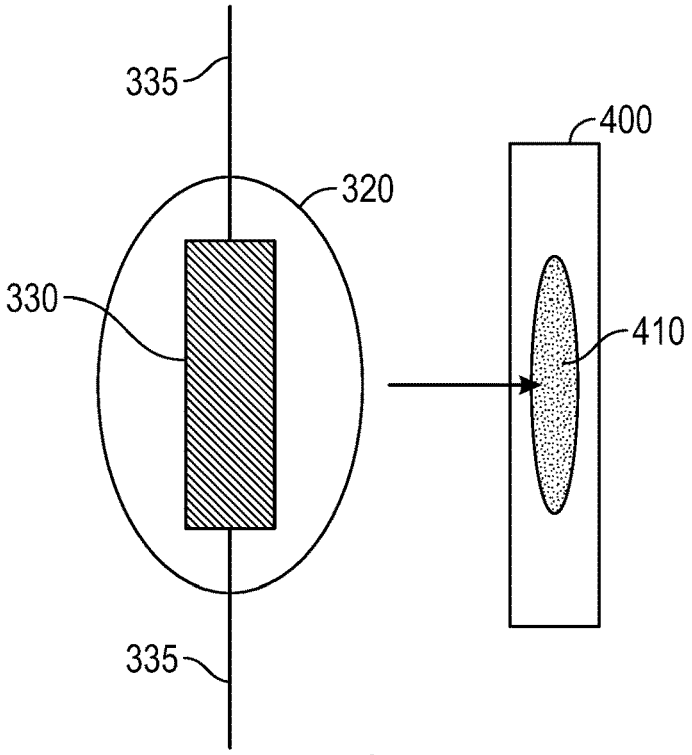
FIG. 3F is an example protection sleeve sensor according to at least one embodiment of the present disclosure.

The shroud 320 may be approximately from ½ inch to 3 inches, alternatively, from ¾ inch to 2 inches, and may be up to approximately 1 inch outer diameter (OD). Accordingly when spooled onto spool 105 as part of the array of sensors 100, the shroud 320 and the contained sensor may need additional protection. Using a pool noodle concept, a tubular protection sleeve with a central bore could be placed over the shroud 320. One method for carrying this out would be to provide a slit the protection sleeve in the axial direction, and wrap around the shroud 320 above and below it. For instance, FIG. 3F is a schematic diagram of the shroud 320 with sensor 330 which may be inserted in a protection sleeve 400 via slit 410, and then spooled on to spool 105 (spool 105 illustrated in FIG. 1). The protection sleeve 400 may be made up of a soft material such as foam or an elastomeric material. This protection sleeve 400 would help with protection of the system when spooled, and is simple, inexpensive and easy to install/remove.

The snorkel line 315 may be communicatively coupled to the sensor 330 using multiple methods; for example, a snorkel line 315 can be welded to the sensor 330 or can be removably attached using a connector, fitting, or an attached sealed housing/fixture. The snorkel line 315 can be attached to either the sensor, the tubing coupler, both, or another piece of equipment.

Figure 3G:
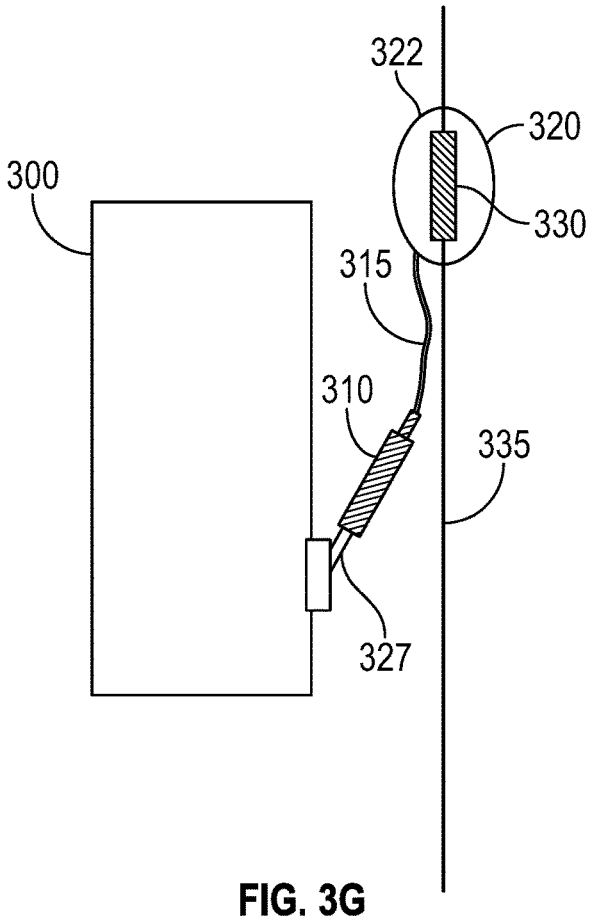
FIG. 3G is an example direct porting to a tubular according to at least one embodiment of the present disclosure.

Although collar 305 is shown in FIGS. 3A-D, the snorkel need not be communicatively (e.g., fluidically) coupled via the collar or attached there to. For example there may be a substitute tubular (which may be a pup joint) which is fitted with a sensor port having a coupling end (such as a male or female end), where a coupling end of a connector (such as a female or male end) may couple to the coupling end. Illustrated in FIG. 3G is a schematic diagram of the connector 310 coupled with a coupling port 327 of the tubular 300. Accordingly, coupling port 327 would provide fluidic communication from the connector 310 to the sensor port 350 and central flow passage 360 (illustrated in FIG. 2). This may be employed where there is a limitation as to space, and thus omission of the collar may provide a smaller outer diameter of the tool. Accordingly, as illustrated in FIG. 3G a collar can be omitted, and the connector communicatively (fluidically) coupled directly to the tubular sensor port 350 without an intervening collar. Alternative ways of coupling the connector include welding a block onto the tubular (such as a pup joint), or machining an eccentric tubular with a block machined thereon. Therefore, the connector can be coupled directly to the tubular 300, a modified tubular or a tubular fitted via a collar.

Figure 3H:
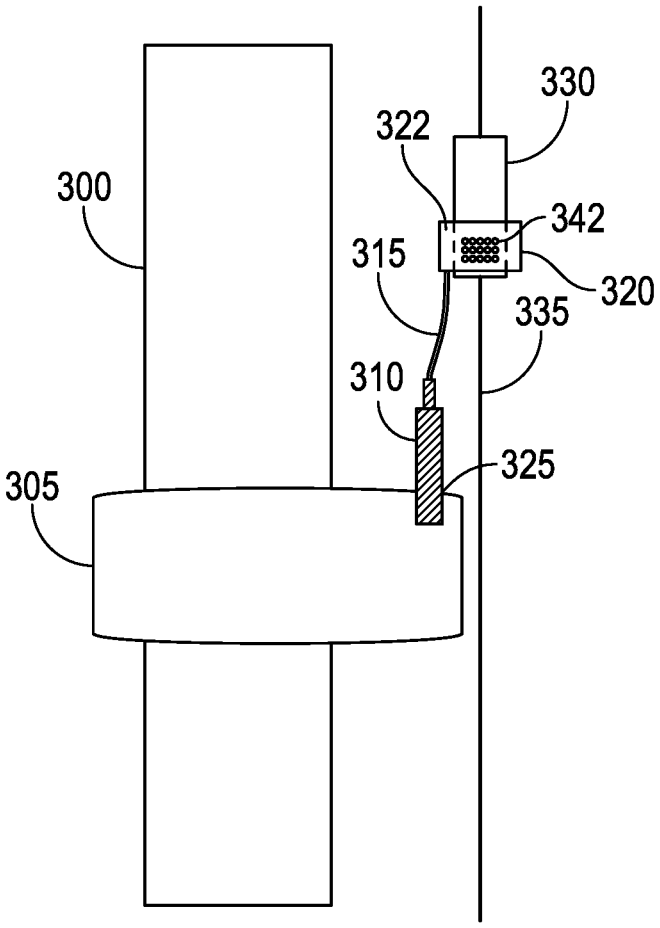
FIG. 3H is an example shroud partially covering a sensor according to at least one embodiment of the present disclosure.

FIG. 3H is a schematic diagram of an alternative method of attaching the snorkel line 315. As illustrated the shroud 320 may be provided to partially cover the detector ports 342 of the sensor 330. The shroud 320 could be sized such that all of the desired collars could be slid over the bottom portion of the sensor 330 to cover the detector ports 342. Seals, such as O-rings could be provided within the shroud 320 above and below the detector ports 340, thus preventing entrance of annulus fluid. The shroud 320 may be fastened to the sensors via any method such as a set screw, collet and lock nut, or other method. The snorkel line 315 may be welded to the collar, pre-terminated with a fitting, or cut to length and terminated at installation using appropriate fittings. This configuration facilitates deployment, as the shroud 320 could be easily slid over the sensor at installation, allowing any sensor 330 of an array of sensors 100 to be configured as a snorkeled sensor. An operator can omit placing the shroud on a sensor of the array of sensors 100 during installation, thereby leaving the detector ports 342 open to the annulus 40 upon deployment, and therefore act as an annulus sensor. Thus, during installation, sensors could be fitted with the shroud 320 to detect fluid inside a tubular string or left unshrouded to act as annulus sensors, and may be conducted in alternating fashion. Moreover, the shrouded and unshrouded sensors may be interleaved in any order to meet the sensing requirements of the sensor array.

Figure 3I:
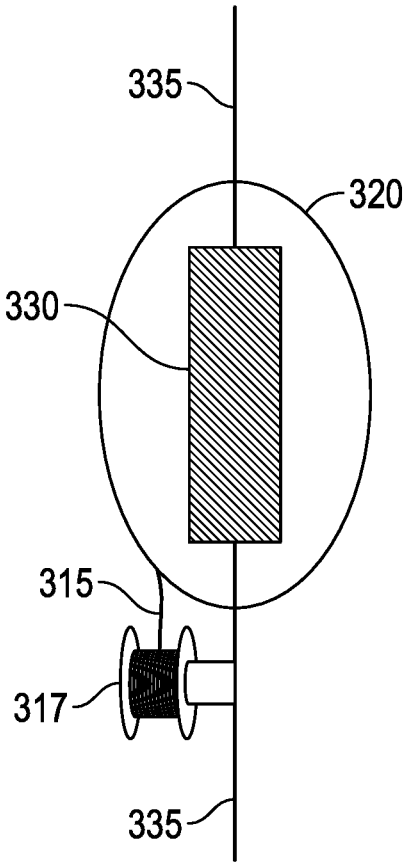
FIG. 3I is an example reel according to at least one embodiment of the present disclosure

Spooling and handling the snorkel could be accomplished by winding the snorkel (for instance a control line which may be ⅛ inch, or alternatively from 1/16 inch to 1 inch, alternatively from ⅛ inch to ½ inch) around a bobbin (reel or spool) that is coaxial, or otherwise, with the shroud 320, or other housing, for the sensor. FIG. 3I is a schematic diagram of a reel 317 provided upon which the snorkel line 315 can be wound. At installation, this snorkel line could be un-spooled and terminated, without the need to be cut, as additional line could be left in place on the bobbin. Alternately, the bobbin and snorkel line could be attached to the coupling, and terminated to the sensor at installation. This would allow the line to be welded, or otherwise permanently attached to the coupling to minimize the eccentricity of the coupling.

Additionally, if the array sensor is manufactured with two sets of detector ports (such as 340A and 340B in FIG. 3E), one may be connected to the snorkel line using the methods mentioned, while the other could be left without a snorkel line. The array of sensors disclosed herein may alternate between sensors having the shroud and snorkel line as disclosed in FIGS. 3A-3H and conventional sensors without the shroud and snorkel line. Accordingly, the array of sensors 100 of FIG. 1 may include a plurality of sensors as described according to FIGS. 3A-3H, as well as conventional sensors without the shroud and snorkel line, and may be arranged to alternate between the one and the other.

The sensors on the array of sensors can be temperature or pressure sensors, or both. The sensor can be a resonance-based pressure sensor, or a strain-based pressure sensor. The resonance-based pressure sensor, like a quartz pressure sensors, measure the frequency change in an oscillator as the hydrostatic pressure changes. A strain-based pressure sensor measures the deflection of a structure due to a pressure differential between hydrostatic pressure and an air chamber. The sensors in the array of sensors may also measure other well parameters, including vibration, wellbore chemistry, or radioactivity among others.

Figure 4:
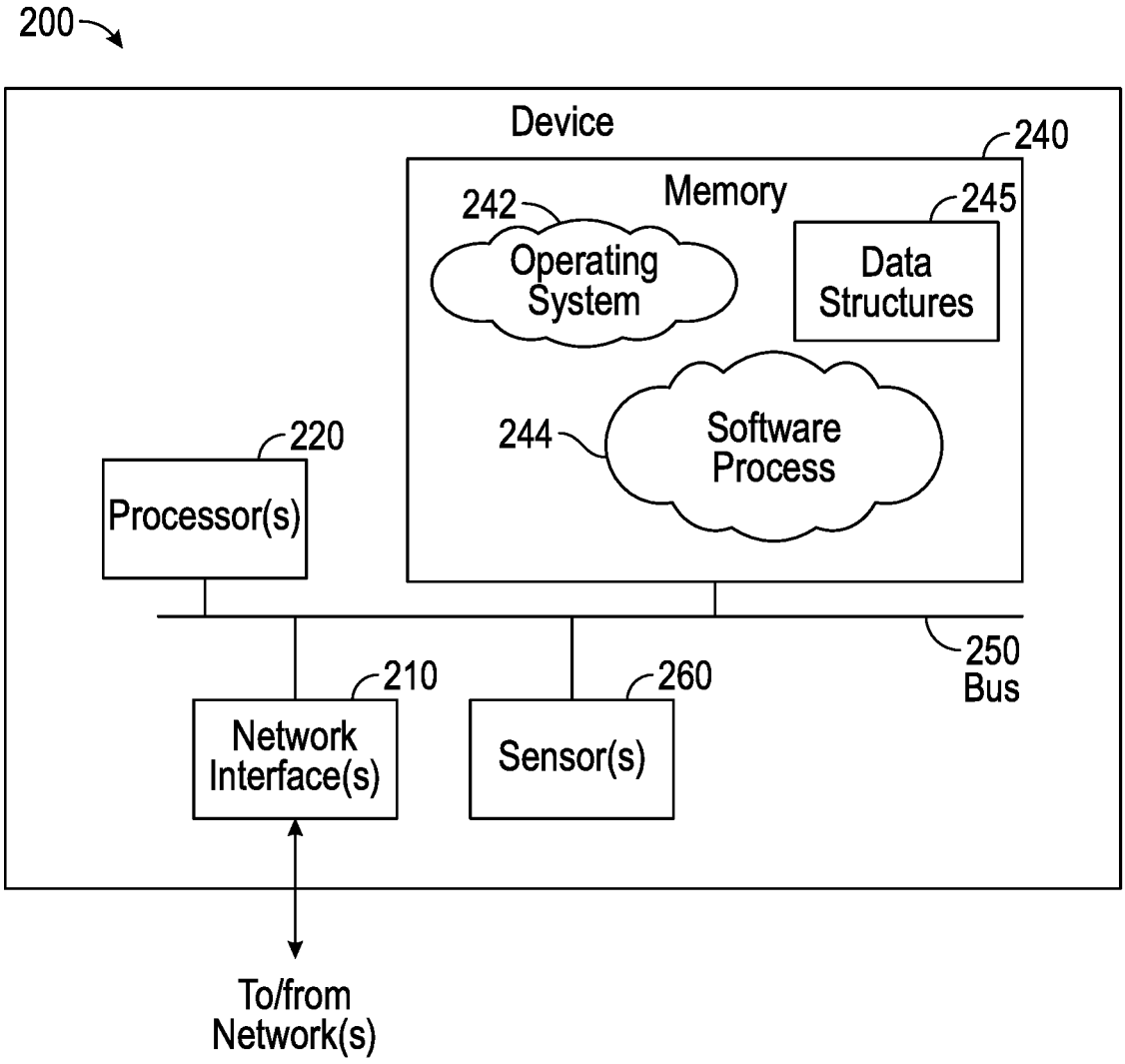
FIG. 4 is a schematic diagram of a processing device which may be employed with the disclosure herein.

FIG. 4 is a block diagram of an exemplary device 200. Device 200 is configured to perform processing of data and communicate with the sensors 101 of the array of sensors 100. In operation, device 200 communicates with one or more of the above-discussed borehole components and may also be configured to communication with remote devices/systems.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communication links, which may include wired or wireless communication links. Network interfaces 210 are configured to transmit and/or receive data using a variety of different communication protocols, as will be understood by those skilled in the art.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260, which may include the sensors 101 of the array of sensors 100 as disclosed herein, typically operate in conjunction with processor 220 to perform wellbore measurements, and can include special-purpose processors, detectors, transmitters, receivers, and the like. In this fashion, sensors 260 may include hardware/software for generating, transmitting, receiving, detection, logging, and/or sampling magnetic fields, seismic activity, and/or acoustic waves, or other well parameters.

Memory 240 comprises a plurality of storage locations that are addressable by processor 220 for storing software programs and data structures 245 associated with the embodiments described herein. An operating system 242, portions of which are typically resident in memory 240 and executed by processor 220, functionally organizes the device by, inter alia, invoking operations in support of software processes and/or services 244 executing on device 200. These software processes and/or services 244 may perform processing of data and communication with device 200, as described herein. Note that while process/service 244 is shown in centralized memory 240, some embodiments provide for these processes/services to be operated in a distributed computing network.

It will be apparent to those skilled in the art that other processor and memory types, including various computer-readable media, may be used to store and execute program instructions pertaining to the borehole evaluation techniques described herein. Also, while the description illustrates various processes, it is expressly contemplated that various processes may be embodied as modules having portions of the process/service 244 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

The embodiments shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the embodiments described above can be modified within the scope of the present disclosure.

Numerous examples are provided herein to enhance understanding of the present disclosure. A specific set of statements are provided as follows.

Statement 1: An array of sensors including: a plurality of connected sensors, wherein at least one of the plurality of connected sensors is at least partially encompassed in a shroud; and a snorkel line extending from the shroud, the snorkel line capable of establishing fluid communication between the at least one of the plurality of connected sensors at least partially encompassed in the shroud and a corresponding sensor port Statement 2: The array of sensors of Statement 1, wherein at least one of the plurality of connected sensors is fully encompassed in the shroud.

Statement 3: The array of sensors of Statement 1, wherein the at least one of the plurality of connected sensors at least partially encompassed in the shroud has a plurality of detector ports, and the shroud covers each of the plurality detector ports.

Statement 4: The array of sensors of claim 1, wherein the at least one of the plurality of connected sensors at least partially encompassed in the shroud includes a plurality of detector ports, wherein at least one set of the plurality of detector ports is covered by the shroud and at least one set of the plurality of detector ports is not covered by a shroud.

Statement 5: The array according to any one of preceding Statements 1-4, wherein the plurality of connected sensors are connected via a conductive line.

Statement 6: The array according to any one of preceding Statements 1-5, wherein the snorkel line is on a bobbin coupled with the at least one of the plurality of connected sensors at least partially encompassed in the shroud.

Statement 7: The array according to any one of preceding Statements 1-6, wherein the at least one of the plurality of connected sensors partially encompassed by a shroud is at least one of a temperature sensor or pressure sensor.

Statement 8: The array according to any one of preceding Statements 1-7, wherein a second sensor of the array is not covered by a shroud.

Statement 9: The array according to any one of preceding Statements 1-8, wherein the array of sensors has at least one shroud covered sensor and at least one uncovered sensor along a length of the array.

Statement 10: A tubular string including: a tubular having a central flow passage for an internal fluid and an external surface; a sensor port along a length of the tubular; a sensor arranged outside of the external surface of the tubular; and a snorkel line communicatively coupling the sensor with the sensor port, the coupling sufficient for the sensor to detect a property of the internal fluid in the central flow passage via the snorkel line.

Statement 11: The tubular string of Statement 10, wherein the sensor is at least partially encompassed by a shroud, the snorkel line extending from the shroud.

Statement 12: The tubular string of Statement 10 or 11, further comprising a connector communicatively coupling the snorkel line with the sensor port.

Statement 13: The tubular string according to any one of preceding Statements 10-12, wherein the communicative coupling of the snorkel line with the connector comprises a seal.

Statement 14: The tubular string according to any one of preceding Statements 10-13, wherein the connector is a ferrule type tubing connector.

Statement 15: The tubular string according to any one of preceding Statements 10-14, further comprising a collar coupled with the tubular and positioned over the sensor port, the collar having a collar port communicatively coupling the snorkel line with the sensor port.

Statement 16: The tubular string according to any one of preceding Statements 10-15, wherein the collar port is an aperture in the collar extending to the sensor port.

Statement 17: The tubular string according to any one of preceding Statements 10-16, the collar having a seat for receiving the connector.

Statement 18: The tubular string according to any one of preceding Statements 10-17, further comprising a collar around the tubular and positioned over the sensor port, the collar permitting communicative coupling of the snorkel line with the sensor port to detect a property of the internal fluid in the central flow passage via the snorkel line.

Statement 19: The tubular string according to any one of preceding Statements 10-18, wherein the snorkel line is on a bobbin coupled with the sensor.

Statement 20: The tubular string according to any one of preceding Statements 10-19, wherein the sensor port is an aperture extending from the external surface of the tubular to the central flow passage.

Statement 21: The tubular string according to any one of preceding Statements 10-20, the sensor being one of an array of sensors extending along a length of the tubular string.

Statement 22: The tubular string according to any one of preceding Statements 10-21, wherein a second sensor of the array of sensors detects a property of a fluid in an annulus.

Statement 23: The tubular string according to any one of preceding Statements 10-22, wherein the sensor is a temperature or pressure sensor.

Statement 24: The tubular string according to any one of preceding Statements 10-23, wherein the communicative coupling is a fluidic communication.

Statement 25: A method comprising: inserting an array of sensors into a wellbore along a length of a tubular string, a snorkel line extending from at least one sensor of the array of sensors, at least one tubular of the tubular string having a central flow passage and an external surface, the tubular string having a sensor port along a length of the tubular, communicatively coupling the snorkel extending from the at least one sensor with the sensor port, the coupling sufficient for the one or more of the sensors having the snorkel line extending therefrom to detect a property of an internal fluid in the central flow passage via the snorkel line.

Statement 26: The method of Statement 25, wherein the at least one sensor of the array of sensors having the snorkel line is at least partially encompassed by a shroud, the snorkel line extending from the shroud.

Statement 27: The method of Statement 25 or 26, further comprising a connector coupling the snorkel line with at least one sensor port.

Statement 28: The method according to any one of preceding Statements 25-27, further comprising a connector coupling the snorkel line with at least one sensor port.

Statement 29: The method according to any one of preceding Statements 25-28, wherein the connector is a ferrule type tubing connector.

Statement 30: The method according to any one of preceding Statements 25-29, further comprising a collar coupled with the tubular and positioned over the sensor port, the collar having a collar port communicatively coupling the snorkel line with the sensor port.

Statement 31: The method according to any one of preceding Statements 25-30, wherein the collar port is an aperture in the collar extending to the sensor port.

Statement 32: The method according to any one of preceding Statements 25-31, the collar having a seat for receiving the connector.

Statement 33: The method according to any one of preceding Statements 25-32, further comprising a collar around the tubular and positioned over the sensor port, the collar permitting communicative coupling of the snorkel with the sensor port to detect a property of the internal fluid in the central flow passage via the snorkel line.

Statement 34: The method according to any one of preceding Statements 25-33, wherein the sensor port is an aperture extending from the external surface of the tubular to the central flow passage.

Statement 35: The method according to any one of preceding Statements 25-34, wherein the at least one sensor of the array of sensors being connected via a conductive line to a second sensor in the array of sensors.

Statement 36: The method according to any one of preceding Statements 25-35, wherein a second sensor of the array of sensors detects a property of a fluid in an annulus.

Statement 37: The method according to any one of preceding Statements 25-36, wherein the communicative coupling is a fluidic communication.

Statement 38: A method comprising: inserting a collar over a tubular in a tubular string, the tubular having a sensor port; positioning the collar over the sensor port in the tubular string, the collar having a collar port communicatively coupled with the sensor port; communicatively coupling a snorkel between a sensor and the sensor port.

Statement 39: The method of Statement 38, further comprising communicatively coupling the snorkel with a connector, the connector having a sealing coupling with snorkel and the connector providing communicative coupling with the sensor port.

Statement 40: The method of Statement 39, wherein the collar has a seat for receiving the connector, and the connector is secured in the seat.

Statement 41: The method according to any one of preceding Statements 38-40, the sensor being one of an array of sensors extending along a length of the tubular string connected via a conductive line.

Statement 42: The method according to any one of preceding Statements 38-41, wherein the communicative coupling is a fluidic coupling.

Statement 43: The method according to any one of preceding Statements 38-42, further comprising deploying the tubular string and the sensor into a wellbore.

Statement 44: A system comprising: a tubular string deployed in a wellbore, the tubular string having a central flow passage for passage of an internal fluid and an external surface; the tubular string having a sensor port along a length of the tubular string extending from the central flow passage to the external surface; an array of sensors connected via a line deployed in the wellbore; and at least one sensor of the array of sensors having a snorkel line communicatively coupling the sensor with the sensor port, the coupling sufficient for the sensor to detect a property of the internal fluid in the central flow passage via the snorkel line.

Statement 45: A system of Statement 44, wherein the at least one sensor of the array of sensors having the snorkel line is at least partially encompassed by a shroud, the snorkel line extending from the shroud.

Statement 46: The system of Statement 44 or 45, further comprising a connector, the connector communicatively coupling the snorkel line with the at least one sensor port.

Statement 47: The system according to any one of preceding Statements 44-46, wherein the coupling of the snorkel line with the connector comprises a seal.

Statement 48: The system according to any one of preceding Statements 44-47, wherein the connector is ferrule type tubing connector.

Statement 49: The system according to any one of preceding Statements 44-48, further comprising a collar coupled with the tubular and positioned over the sensor port, the collar having a collar port communicatively coupling the snorkel line with the sensor port.

Statement 50: The system according to any one of preceding Statements 44-49, the collar having a seat for receiving the connector.

What is claimed:

1. An array of sensors comprising:

a plurality of connected sensors, wherein at least one of the plurality of connected sensors is at least partially encompassed in a shroud; and a snorkel line extending from the shroud, the snorkel line capable of establishing fluid communication between the at least one of the plurality of connected sensors at least partially encompassed in the shroud and a corresponding sensor port, wherein the array of sensors has at least one shroud covered sensor and at least one uncovered sensor along a length of the array.

2. The array of sensors of claim 1, wherein at least one of the plurality of connected sensors is fully encompassed in the shroud.

3. The array of sensors of claim 1, wherein the at least one of the plurality of connected sensors at least partially encompassed in the shroud has a plurality of detector ports, and the shroud covers each of the plurality detector ports.

4. The array of sensors of claim 1, wherein the at least one of the plurality of connected sensors at least partially encompassed in the shroud includes a plurality of detector ports, wherein at least one set of the plurality of detector ports is covered by the shroud and at least one set of the plurality of detector ports is not covered by a shroud.

5. The array of sensors of claim 1, wherein the plurality of connected sensors are connected via a conductive line.

6. The array of sensors of claim 1, wherein the snorkel line is on a bobbin coupled with the at least one of the plurality of connected sensors at least partially encompassed in the shroud.

7. The array of sensors of claim 1, wherein the at least one of the plurality of connected sensors partially encompassed by a shroud is at least one of a temperature sensor or pressure sensor.

8. A tubular string comprising:

a tubular having a central flow passage for an internal fluid and an external surface;

a sensor port along a length of the tubular;

a first sensor arranged outside of the external surface of the tubular; and a snorkel line communicatively coupling the first sensor with the sensor port, the coupling sufficient for the first sensor to detect a property of the internal fluid in the central flow passage via the snorkel line, wherein the first sensor is at least partially encompassed by a shroud, the snorkel line extending from the shroud; and a second sensor connected to the first sensor to form an array of sensors, wherein the second sensor is not covered by a shroud.

9. The tubular string of claim 8, further comprising a connector communicatively coupling the snorkel line with the sensor port.

10. The tubular string of claim 9, wherein the communicative coupling of the snorkel line with the connector comprises a seal.

11. The tubular string of claim 9, wherein the connector is a ferrule type tubing connector.

12. The tubular string of claim 9, further comprising a collar coupled with the tubular and positioned over the sensor port, the collar having a collar port communicatively coupling the snorkel line with the sensor port.

13. The tubular string of claim 12, wherein the collar port is an aperture in the collar extending to the sensor port.

14. The tubular string of claim 12, the collar having a seat for receiving the connector.

15. The tubular string of claim 8, further comprising a collar around the tubular and positioned over the sensor port, the collar permitting communicative coupling of the snorkel line with the sensor port to detect a property of the internal fluid in the central flow passage via the snorkel line.

16. The tubular string of claim 8, wherein the snorkel line is on a bobbin coupled with the first sensor.

17. The tubular string of claim 8, wherein the sensor port is an aperture extending from the external surface of the tubular to the central flow passage.

18. The tubular string of claim 8, the sensor being one of an array of sensors extending along a length of the tubular string.

19. The tubular string of claim 18, wherein a second sensor of the array of sensors detects a property of a fluid in an annulus.

20. The tubular string of claim 8, wherein the sensor is a temperature or pressure sensor.

21. The tubular string of claim 8, wherein the communicative coupling is a fluidic communication.

22. A method comprising:

inserting an array of sensors into a wellbore along a length of a tubular string, a snorkel line extending from at least one sensor of the array of sensors, at least one tubular of the tubular string having a central flow passage and an external surface, the tubular string having a sensor port along a length of the tubular, and communicatively coupling the snorkel line extending from the at least one sensor with the sensor port, the coupling sufficient for the one or more of the sensors having the snorkel line extending therefrom to detect a property of an internal fluid in the central flow passage via the snorkel line, wherein the at least one sensor of the array of sensors having the snorkel line is at least partially encompassed by a shroud, the snorkel line extending from the shroud, and wherein the array of sensors has at least one shroud covered sensor and at least one uncovered sensor along a length of the array.

23. The method of claim 22, further comprising a connector coupling the snorkel line with at least one sensor port.

24. The method of claim 23, wherein the coupling of the snorkel line with the connector comprises a seal.

25. The method of claim 24, wherein the connector is a ferrule type tubing connector.

26. The method of claim 25, further comprising a collar coupled with the tubular and positioned over the sensor port, the collar having a collar port communicatively coupling the snorkel line with the sensor port.

27. The method of claim 26, wherein the collar port is an aperture in the collar extending to the sensor port.

28. The method of claim 26, the collar having a seat for receiving the connector.

29. The method of claim 22, further comprising a collar around the tubular and positioned over the sensor port, the collar permitting communicative coupling of the snorkel line with the sensor port to detect a property of the internal fluid in the central flow passage via the snorkel line.

30. The method of claim 22, wherein the sensor port is an aperture extending from the external surface of the tubular to the central flow passage.

31. The method of claim 22, wherein the at least one sensor of the array of sensors being connected via a conductive line to a second sensor in the array of sensors.

32. The method of claim 22, wherein a second sensor of the array of sensors detects a property of a fluid in an annulus.

33. The method of claim 22, wherein the communicative coupling is a fluidic communication.

34. A system comprising:

a tubular string deployed in a wellbore, the tubular string having a central flow passage for passage of an internal fluid and an external surface;

the tubular string having a sensor port along a length of the tubular string extending from the central flow passage to the external surface;

an array of sensors connected via a line deployed in the wellbore; and at least one sensor of the array of sensors having a snorkel line communicatively coupling the sensor with the sensor port, the coupling sufficient for the sensor to detect a property of the internal fluid in the central flow passage via the snorkel line, wherein the at least one sensor of the array of sensors having the snorkel line is at least partially encompassed by a shroud, the snorkel line extending from the shroud, and wherein the array of sensors has at least one shroud covered sensor and at least one uncovered sensor along a length of the array.

35. The system of claim 34, further comprising a connector, the connector communicatively coupling the snorkel line with the at least one sensor port.

36. The system of claim 35, wherein the coupling of the snorkel line with the connector comprises a seal.

37. The system of claim 35, wherein the connector is ferrule type tubing connector.

38. The system of claim 35, further comprising a collar coupled with the tubular string and positioned over the sensor port, the collar having a collar port communicatively coupling the snorkel line with the sensor port.

39. The system of claim 38, the collar having a seat for receiving the connector.

40. An array of sensors comprising:

a plurality of connected sensors, wherein at least one of the plurality of connected sensors is at least partially encompassed in a shroud; and a snorkel line extending from the shroud, the snorkel line capable of establishing fluid communication between the at least one of the plurality of connected sensors at least partially encompassed in the shroud and a corresponding sensor port, wherein the at least one of the plurality of connected sensors at least partially encompassed in the shroud has a plurality of detector ports, and the shroud covers each of the plurality detector ports.

41. An array of sensors comprising:

a plurality of connected sensors, wherein at least one of the plurality of connected sensors is at least partially encompassed in a shroud; and a snorkel line extending from the shroud, the snorkel line capable of establishing fluid communication between the at least one of the plurality of connected sensors at least partially encompassed in the shroud and a corresponding sensor port, wherein the at least one of the plurality of connected sensors at least partially encompassed in the shroud includes a plurality of detector ports, and wherein at least one set of the plurality of detector ports is covered by the shroud and at least one set of the plurality of detector ports is not covered by a shroud.

* * * * *